United States Patent [19]

Hirosawa et al.

[11] 4,011,844

[45] Mar. 15, 1977

[54] AUTOMATIC CHOKE VALVE APPARATUS IN AN INTERNAL COMBUSTION ENGINE

[75] Inventors: Yoshiaki Hirosawa, Tokyo; Toshio Nomura, Niiza; Masahiko Iiyama, Tokyo, all of Japan

[73] Assignee: Honda Giken Kogyo Kabushiki Kaisha, Tokyo, Japan

[22] Filed: June 16, 1975

[21] Appl. No.: 587,383

[52] U.S. Cl. ..... 123/119 F; 261/39 E; 261/64 R; 261/39 R

[51] Int. Cl.[2] ..... F02M 1/10; F02D 11/08; F02M 23/04

[58] Field of Search ..... 123/119 F, 179 G; 261/39 B, 39 E, 39 R, 64 R

[56] References Cited

UNITED STATES PATENTS

| | | | |
|---|---|---|---|
| 3,401,919 | 9/1968 | Seufert et al. | 123/119 F |
| 3,534,720 | 10/1970 | DuBois | 123/119 F |
| 3,818,881 | 6/1974 | Hosho | 123/119 F |
| 3,948,240 | 4/1976 | Hirosawa et al. | 123/179 G |

*Primary Examiner*—Wendell E. Burns

[57] ABSTRACT

Automatic choke valve apparatus for an internal combustion engine in which the degree of opening of a choke valve is selectively controlled by a drive pulse motor drivingly coupled to the valve. A pulse circuit controls the pulse motor, and comprises a pulse generator which oscillates at a fixed frequency and produces an output pulse signal for operating the drive pulse motor, and a variable type flicker coupled to the output of the pulse generator for intermittently controlling the output pulse signal in accordance with engine temperature.

4 Claims, 4 Drawing Figures

AUTOMATIC CHOKE VALVE APPARATUS IN AN INTERNAL COMBUSTION ENGINE

CROSS-RELATED APPLICATION

This application is related in subject matter to U.S. application Ser. No. 558,714 filed Mar. 14, 1975, now U.S. Pat. No. 3,948,240 of Apr. 6, 1976 having the same inventor and assignee entity as the instant application and incorporates the contents thereof hereinto by way of reference.

FIELD OF THE INVENTION

This invention relates to automatic choke valve apparatus for an internal combustion engine for a motorcar or the like.

BACKGROUND

The Applicants have previously proposed in U.S. application Ser. No. 558,714 a type of apparatus in which a choke valve within an inlet passage of an internal combustion engine is provided on one side thereof with a pulse motor connected thereto and connected to a drive pulse circuit, so that the valve is controlled according to engine temperature by driving the pulse motor by an output pulse signal from the circuit, which corresponds to engine temperature.

In the aforesaid application, a pulse generator constituting the drive pulse circuit is constructed as a variable frequency type oscillator whose oscillation frequency is varied by a temperature sensitive type variable resistor which varies in resistance value according to engine temperature. However, with this arrangement, the pulse motor must be a variable speed type motor whose output speed of revolution is varied according to change of input pulse frequency. This type of motor is comparatively expensive.

SUMMARY OF THE INVENTION

An object of this invention is to provide an apparatus which avoids such disadvantage.

According to this invention, in an automatic choke valve apparatus of the type in which a choke valve within an inlet passage of an internal combustion engine is connected to a pulse motor in turn connected to a drive pulse circuit such that the choke valve is controllably opened by driving the motor by an output pulse signal of the circuit, the apparatus is characterized in that the drive pulse circuit is composed of a pulse generator which oscillates at a fixed frequency and to the output thereof a flicker is connected whose intermittent property is controlled according to engine temperature.

An embodiment of this invention will next be described with reference to the accompanying drawings.

DETAILED DESCRIPTION

Figure 1:
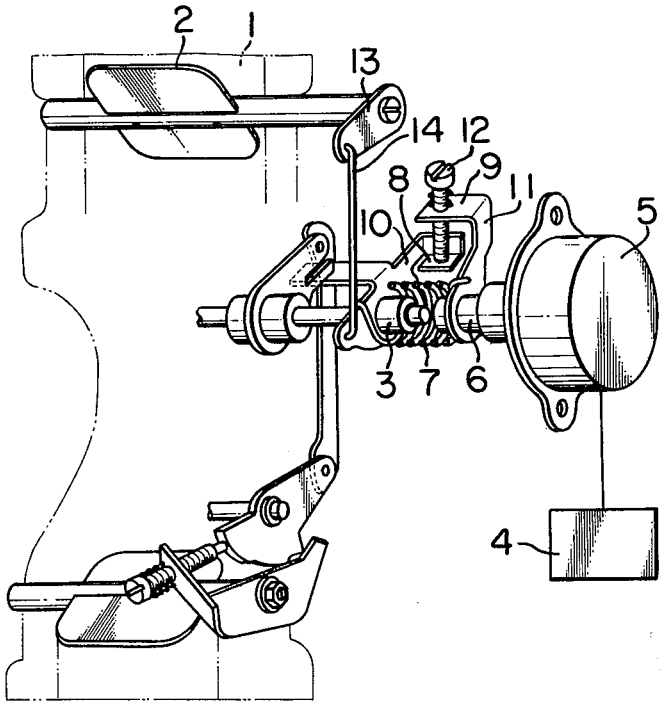
FIG. 1 is a perspective view of one embodiment of the apparatus according to this invention.

Referring to the drawings, numeral 1 denotes an inlet passage of an internal combustion engine, numeral 2 denotes a choke valve mounted in passage 1 so as to be freely opened and closed and numeral 3 denotes an operation shaft connected to valve 2. A pulse motor 5 is connected to a drive pulse circuit 4 and a driving shaft 6 is drivingly connected to the motor 5. The operation shaft 3 and the driving shaft 6 are interconnected through an intermediate torsion spring 7 and they are also in engagement with one another through circumferentially disposed front and rear pawls 8,9 so that a feed-drive can be given only in the regular direction of rotation of shaft 6, which is clockwise in the drawings. In the illustrated embodiment, the operation shaft 3 and the driving shaft 6 have respective side arms 10,11 projecting therefrom and these arms have respective end portions constituting the front and rear pawls 8 and 9. A screw 12 is mounted in pawl 9 for adjusting the engaging position between the two pawls. The shaft of choke valve 2 is connected at its outer end by choke lever 13 to the tail end of the side arm 10 through a rod 14.

The details of the drive pulse circuit 4 are not explained here but can be found in the previously denoted application Ser. No. 558,714. The circuit 4 is so constructed that it can be changed over between first through fourth operation conditions by respectively detecting closing of the engine ignition switch, closing of the engine starter switch, beginning of firing of the engine and continuing of engine firing. Additionally, the arrangement is such that in the first operation condition the motor 5, and accordingly, the driving shaft 6, is driven in reverse direction at relatively high speed; in the second operation condition, the shaft 6 is driven in the regular direction of rotation over a fixed time period at a comparatively high speed corresponding to engine temperature; in the third operation condition the shaft 6 is driven in the regular direction of rotation at a high speed over a fixed time period; and in the fourth operation condition the shaft 6 is driven in the regular direction of rotation at a comparatively low speed corresponding to engine temperature.

Thus, in the operation under the first operation condition the choke valve 2 is given a standard position setting in which the valve is urged toward its closing position by a large resilient force applied by the torsion spring 7 to be in its fully closed position. In the operation under the second operation condition, the choke valve 2 is given a starting position setting in which the resilient force on the valve is relaxed according to the engine temperature. In the operation under the third operation condition, the choke valve 2 is given an open position corresponding to engine firing by being drive in opening direction through the pawls 8,9. Then by the operation under the fourth operation condition, the choke valve 2 is gradually opened according to engine temperature. Further detailed explanation of the circuit is not given here and can be found in the aforesaid U.S. application.

Figure 2:
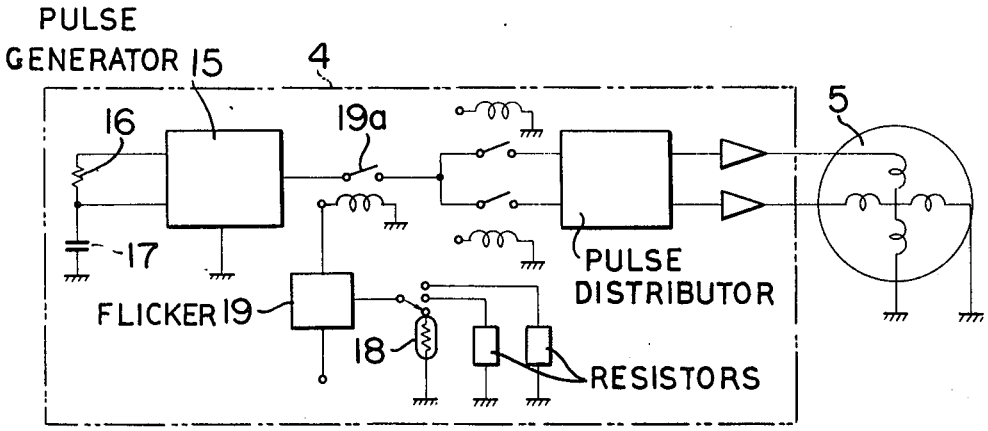
FIG. 2 is a circuit diagram of an electric circuit incorporated therein.
Figure 3:
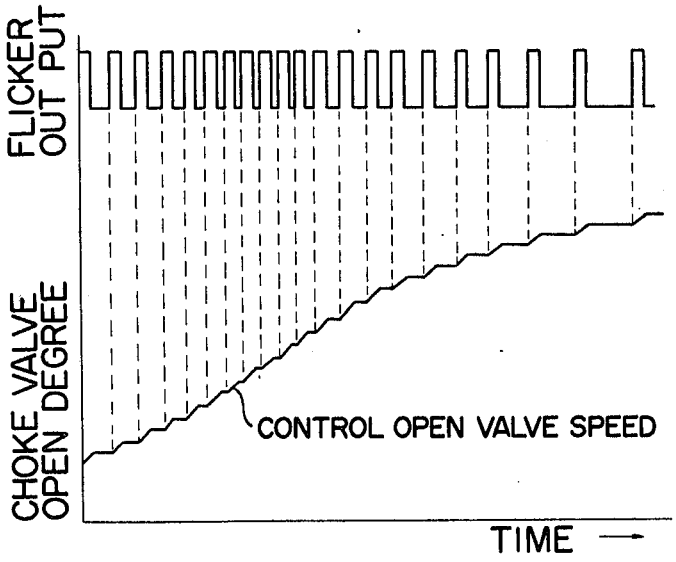
FIG. 3 is a graph showing the operation of the choke valve in accordance with the circuit of FIG. 2.

The present invention is chiefly directed to the control operation of the valve in the fourth operation condition. According to the aforesaid U.S. application Ser. No. 558,714, the pulse generator in the drive pulse circuit 4 is composed of a frequency type oscillator whose oscillation frequency varies according to the engine temperature as mentioned before. The present invention seeks to improve this arrangement. Namely, as shown clearly in FIG. 2, a pulse generator 15, which is the pulse generating source in the drive pulse circuit 4, is constructed as a fixed frequency type oscillator which oscillates at a fixed frequency determined by a fixed resistor 16 and a fixed condenser 17, and there is interposed in a circuit connecting pulse generator 15 and the motor 5 an opening and closing contact 19a of a variable type flicker or switching means 19 whose intermittent property is controlled by a temperature sensitive type variable resistor 18 whose electrical resistance varies according to engine temperature. Thus, the output pulse signal of fixed frequency obtained from the pulse generator 15 is given an intermittent control depending on the engine temperature by the flicker 19 as shown at the upper portion of FIG. 3, and consequently the change in the open degree of the choke valve 2 by the motor 5 corresponds to engine temperature as shown at the lower portion of FIG. 3.

Figure 4:
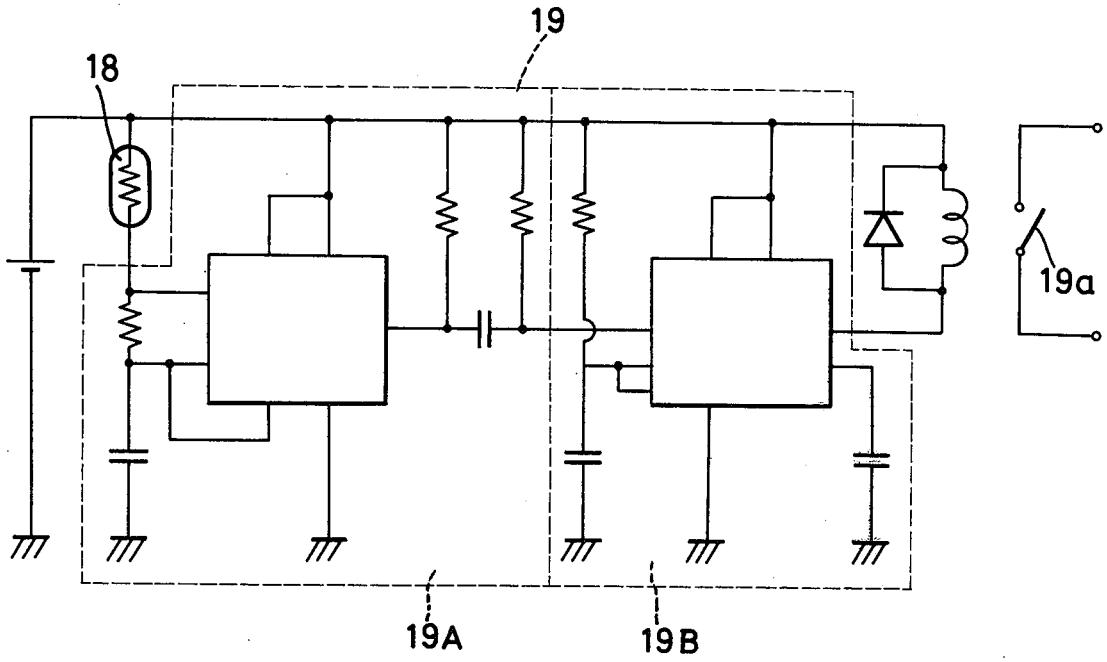
FIG. 4 is a circuit diagram of the flicker in the circuit of FIG. 2.

Referring to FIG. 4, therein is shown the circuit construction of flicker 19. Essentially, flicker 19 comprises the combination of an astable oscillator 19A controlled by the resistor 18 and a monostable oscillator 19B triggered thereby.

Thus, according to this invention, in an arrangement in which the degree of opening of the choke valve is controlled by the pulse motor, the pulse oscillator in the drive pulse circuit connected to the motor is constructed of fixed frequency type which oscillates at a fixed frequency and the output pulse signal of the oscillator controlled by the flicker whose intermittent property corresponds to the engine temperature, so that the motor can be of fixed frequency and fixed speed type which rotates at a fixed speed by a fixed frequency pulse signal. Therefore the construction becomes simple and economical in comparison with the case where the motor is of a variable speed type, and thus the choke valve control can be operated without any troubles over long periods of time.

What is claimed is:

1. In automatic choke valve apparatus for an internal combustion engine in which the degree of opening of a choke valve is selectively controlled by a drive pulse motor drivingly coupled to the valve and a pulse circuit controlling the pulse motor, the improvement wherein said circuit comprises a pulse generator which oscillates at a fixed frequency, and produces an output pulse signal for operation the drive pulse motor, and means coupled to said pulse generator at the output thereof for intermittently controlling the output pulse signal in accordance with engine temperature.

2. The improvement as claimed in claim 1 wherein the intermittent control means includes a temperature sensitive variable resistor.

3. The improvement as claimed in claim 2 wherein the intermittent control means further includes a variable type flicker coupled to said temperature sensitive variable resistor, and including switch means connected to the output of the pulse generator.

4. The improvement as claimed in claim 1 wherein said pulse motor is of fixed frequency type and rotates at a fixed speed.

* * * * *